US009867394B2

(12) United States Patent
Giannini et al.

(10) Patent No.: US 9,867,394 B2
(45) Date of Patent: Jan. 16, 2018

(54) METHOD AND DEVICE FOR SUPPLYING FILTER MATERIAL TO A FILTER ROD FORMING MACHINE

(71) Applicant: MONTRADE S.R.L., Bologna (IT)

(72) Inventors: Antonella Giannini, Bologna (IT); Alberto Monzoni, Bologna (IT)

(73) Assignee: MONTRADE S.R.L., Bologna (IT)

( * ) Notice: Subject to any disclaimer, the term of this patent is extended or adjusted under 35 U.S.C. 154(b) by 579 days.

(21) Appl. No.: 14/383,259

(22) PCT Filed: Mar. 5, 2013

(86) PCT No.: PCT/IB2013/051745

§ 371 (c)(1),
(2) Date: Sep. 5, 2014

(87) PCT Pub. No.: WO2013/132434

PCT Pub. Date: Sep. 12, 2013

(65) Prior Publication Data

US 2015/0018187 A1 Jan. 15, 2015

(30) Foreign Application Priority Data

Mar. 5, 2012 (IT) ..... BO2012A0106
Jul. 30, 2012 (IT) ..... BO2012A0413

(51) Int. Cl.
*A24D 3/02* (2006.01)

(52) U.S. Cl.
CPC ..... *A24D 3/0208* (2013.01); *A24D 3/0204* (2013.01); *A24D 3/0212* (2013.01); *A24D 3/0216* (2013.01)

(58) Field of Classification Search
CPC ..... A24D 3/00; A24D 3/02; A24D 3/0204; A24D 3/0208; A24D 3/0212; A24D 3/0216; A24D 3/0225; A24D 3/0229
(Continued)

(56) References Cited

U.S. PATENT DOCUMENTS 3,016,945 A * 1/1962 Wexler ..... A24D 3/0233 156/166
3,238,852 A * 3/1966 Milton ..... A24D 3/0204 493/45

(Continued)

FOREIGN PATENT DOCUMENTS

GB 1151634 A * 5/1969 ..... A24D 3/02
JP 46-5039 2/1971

(Continued)

OTHER PUBLICATIONS

International Search Report for PCT/IB2013/051745 dated Jul. 1, 2013.

(Continued)

*Primary Examiner* — Gloria R Weeks
*Assistant Examiner* — William A Weller
(74) *Attorney, Agent, or Firm* — Heslin Rothenberg Farley & Mesiti P.C.; Victor A. Cardona, Esq.

(57) ABSTRACT

A method and a device for supplying filter material to a filter rod forming machine, according to which a flat band of filter material, obtained working a single "tow", is longitudinally cut in at least two strips, each of which is fed to a respective pneumatic device adapted to transform the respective strip in a respective cord. The cords are then fed to an inlet of the forming machine at positions evenly distributed about a central axial portion for forming a peripheral axial portion.

25 Claims, 6 Drawing Sheets

(58) Field of Classification Search
USPC .... 493/4, 39, 42, 44, 45, 46, 47, 48, 49, 50, 493/67, 75
See application file for complete search history.

(56) References Cited

U.S. PATENT DOCUMENTS 3,323,961 A * 6/1967 Gallagher ..... A24D 3/0233 156/180
3,371,000 A 2/1968 Davenport et al.
3,494,263 A * 2/1970 Tachibana ..... A24D 3/02 264/128
3,546,325 A * 12/1970 Muller ..... A24D 3/0237 131/216
3,800,676 A * 4/1974 Levers ..... A24D 3/022 493/44
3,819,435 A * 6/1974 Roberts ..... A24D 3/0233 156/296
3,847,064 A 11/1974 Berger
3,884,741 A * 5/1975 Sexstone ..... A24D 3/0225 131/344
3,910,166 A 10/1975 Sexstone
3,994,306 A * 11/1976 Berger ..... A24D 3/04 131/340
4,024,012 A * 5/1977 Sigmon ..... A24D 3/0279 156/201
4,034,765 A * 7/1977 Hall ..... A24D 3/02 131/336
4,046,063 A * 9/1977 Berger ..... A24D 3/0283 493/43
4,059,043 A * 11/1977 Berger ..... A24D 3/0283 131/340
4,076,479 A * 2/1978 Lacon ..... B29C 35/06 425/301
4,103,596 A * 8/1978 Molins ..... A24C 5/471 493/39
4,109,666 A * 8/1978 Norman ..... A24D 3/0279 131/339
4,179,323 A * 12/1979 Sigmon ..... A24D 3/0279 156/201
4,184,412 A * 1/1980 Hall ..... A24D 3/0225 493/45
4,281,671 A * 8/1981 Bynre ..... A24D 3/0212 131/335
4,291,711 A * 9/1981 Berger ..... A24D 3/043 131/336
4,355,995 A * 10/1982 Berger ..... A24D 3/043 493/43
4,476,807 A * 10/1984 Pryor ..... A24D 3/022 118/300
4,525,161 A * 6/1985 Luke ..... A24D 3/0258 131/341
4,549,875 A * 10/1985 Pryor ..... A24D 3/022 493/44
4,593,706 A * 6/1986 Preston ..... A24C 5/39 131/109.1
4,763,674 A * 8/1988 Lelah ..... A24D 3/08 131/331
4,889,143 A * 12/1989 Pryor ..... A24B 3/14 131/331
4,971,078 A 11/1990 Deutsch et al.
5,116,298 A * 5/1992 Bondanelli ..... A24C 5/34 131/906
5,234,397 A * 8/1993 Wahle ..... A24D 3/0225 493/4
5,331,976 A * 7/1994 St Pierre ..... A24D 3/0233 131/96
5,460,590 A * 10/1995 Greiner ..... A24D 3/0295 493/37
5,725,467 A * 3/1998 Chehab ..... A24D 3/0204 493/42
5,733,234 A 3/1998 Greiner et al.
5,902,431 A * 5/1999 Wilkinson ..... A24C 5/20 156/159
7,740,019 B2 * 6/2010 Nelson ..... A24D 3/0225 131/335
7,770,585 B2 * 8/2010 Fowles ..... A24D 3/022 131/331
7,811,220 B2 * 10/2010 Wolff ..... A24D 3/0204 493/42
8,408,215 B2 * 4/2013 Libbra ..... A24D 3/0212 131/274
9,380,809 B2 * 7/2016 Davis ..... A24D 3/0212
9,392,819 B2 * 7/2016 Giannini ..... A24D 3/0233
9,462,828 B2 * 10/2016 Le Roux ..... A24D 3/0216
2003/0224918 A1 * 12/2003 Lanier, Jr. ..... A24D 3/022 493/39
2006/0135335 A1 * 6/2006 Dawson ..... A24D 3/061 493/39
2011/0190105 A1 * 8/2011 Fallon ..... A24C 5/475 493/39
2012/0065042 A1 * 3/2012 Le Roux ..... A24D 3/061 493/39
2012/0080043 A1 * 4/2012 Naenen ..... A24D 3/061 131/341
2012/0115696 A1 * 5/2012 Davis ..... A24D 3/0212 493/39
2012/0122639 A1 * 5/2012 Davis ..... A24D 3/0212 493/39
2012/0220438 A1 * 8/2012 Herholdt ..... A24D 3/061 493/39
2012/0231946 A1 * 9/2012 Goda ..... D04H 1/407 502/7
2013/0231232 A1 * 9/2013 Giannini ..... A24D 3/0233 493/44
2013/0337987 A1 * 12/2013 Kato ..... A24D 3/0241 493/44
2014/0196728 A1 * 7/2014 Lisan ..... A24D 3/00 131/275

FOREIGN PATENT DOCUMENTS

| | | |
|---|---|---|
| JP | 46-5039 | 11/1971 |
| JP | 50-111297 | 9/1975 |
| NO | 2012/017850 | 2/2012 |
| WO | 02076246 A2 | 10/2002 |
| WO | 2010/115829 A1 | 10/2010 |

OTHER PUBLICATIONS

Organized Translation of Notice of Reasons for Rejection, dated Dec. 13, 2016, for corresponding Japanese application No. 2014-560495.

* cited by examiner 41
1
39
34
32
33
31
35
40
28
5
30
6
III
III
29
36
40
36
27
35
31
33
32
39
34
38
37
41

37

37

37

METHOD AND DEVICE FOR SUPPLYING FILTER MATERIAL TO A FILTER ROD FORMING MACHINE

CROSS REFERENCE TO RELATED APPLICATIONS

This application is a National Stage of PCT International Application No. PCT/IB2013/051745, filed on Mar. 5, 2013, and published in English on Sep. 12, 2013 as WO 2013/132434 A1, which claims priority from Italian Patent Application No. BO 2012 A 000106 filed on Mar. 5, 2012 and Italian Patent Application No. BO 2012 A 000413 filed on Jul. 30, 2012, the entire disclosures of which are incorporated herein by reference.

TECHNICAL FIELD

The present invention relates to a method and a device for supplying filter material to a filter rod forming machine.

In particular, the present invention relates to a method and a device for supplying filter material to a forming machine of "special" filters provided with a peripheral axial portion surrounding a central axial portion, the nature thereof is different from that of the peripheral axial portion.

BACKGROUND ART

By way of example, the central axial portion may consist of a duct of any cross-section; of a continuous wire impregnated with any filter and/or flavouring and/or coloring material; of filter material of different color and/or differently drugged, etc.; or of a series of cavities, each accommodating a flavouring capsule.

In the tobacco industry, it is known to implement a continuous filter rod using a forming machine provided with an inlet unit, the function of which is to unwind, from a bale of compressed filter material, a continuous tow consisting of a bundle of curled fibers of filter material; expand the tow until it takes the shape of a flat band by subjecting it to axial and cross stretching operations, through which the filter curling is staggered with respect to each other; and supply the band to an inlet station of the forming machine by means of a supply device adapted to transversally deform the band so as to transform it into a continuous cord generally having a cylindrical section. A possible "drugging" of the filter material by the addition of flavours, colorants or other additives normally occurs by suitably treating the band of filter material before the latter enters into the supply device and is deformed for forming the continuous filter rod. A common technique of "drugging" treatment of the band of filter material consists, for example, in depositing additive material in the form of a continuous layer or a discrete sequence of sediments on the upper surface of the band so that, when this is deformed by the supply device, the additive material remains incorporated into the filter rod.

According to a different technique, known from U.S. Pat. No. 3,910,166, before supplying the band to the supply device, the band "drugging" treatment includes cutting the band in longitudinal direction so as to form two strips, depositing a layer of additive material on one of the strips and overlapping the strips on each other so as to form again a band of filter material to be supplied to the supply device for forming the filter rod.

The resulting continuous rod is then cut into segments, normally having a multiple length of a normal filter, by means of a rotating cutting head.

If special filters of the above-described type are to be manufactured, it is known to provide, at the inlet station of the forming machine, a forming device of said central axial portion. This device may comprise a mandrel for making an axial duct of any section, or a tubular probe associated with a supply of a continuous wire or of a particulate material consisting, for example, of a flow of flavouring capsules or a flow of granules.

Moreover, if special filters of the above-described type are to be implemented, and for the precise purpose of perfectly centering said central axial portion with respect to said peripheral axial portion, it is known to equip the forming machine with two inlet units, which once the respective "tows" have been picked up from respective bales and have been subjected to the above-described processing series, supply the respective continuous cords so as to tighten said probe between each other as a "sandwich" and keep it perfectly centered.

A similar way of proceeding is not always effective and free from drawbacks.

In the first place, with the exception of the axially pierced filters, implementing the peripheral portion of a special filter capable of producing an acceptable pressure drop using two "tows" often is an expensive operation and not always possible since "tows", which are characterized by the titer and number of fibers they are made of, are only available in a limited number and it is not always possible to find a "tow" on the market capable of forming a half peripheral portion of a "special" filter having the desired pressure drop values; moreover, such a "tow", when available, normally is relatively expensive.

In the second place, since it is not possible to find two identical "tows", since the two "tows", even if identical by titer and number of fibers, cannot have an identical "warehouse history", the two parts of the peripheral portion obtained by using these two "tows" have partly different physical-chemical features. Especially in the production of filters for "thin" cigarettes, such "differences" may be a different response of the two "tows" to treatments, with consequent offset of the central axial portion; and in any case they could cause, in a short time, the onset of internal tensions by effect of which the resulting filter segments tend to get deformed (they normally bend) and to become unusable for subsequent processing.

DISCLOSURE OF INVENTION

The object of the present invention is to provide a method for supplying filter material to a filter rod forming machine, which method allows the above-described drawbacks to be eliminated.

A method is implemented according to the present invention, for supplying filter material to a filter rod forming machine according to claim 1 and preferably, to any of the following claims either directly or indirectly depending on claim 1.

Moreover, a device is provided according to the present invention, for supplying filter material to a filter rod forming machine according to claim 12 and preferably, to any of the following claims either directly or indirectly depending on claim 12.

BRIEF DESCRIPTION OF THE DRAWINGS

The invention will now be described with reference to the accompanying drawings, which show some non-limiting embodiment examples thereof, in which.

BEST MODE FOR CARRYING OUT THE INVENTION

Figure 1:
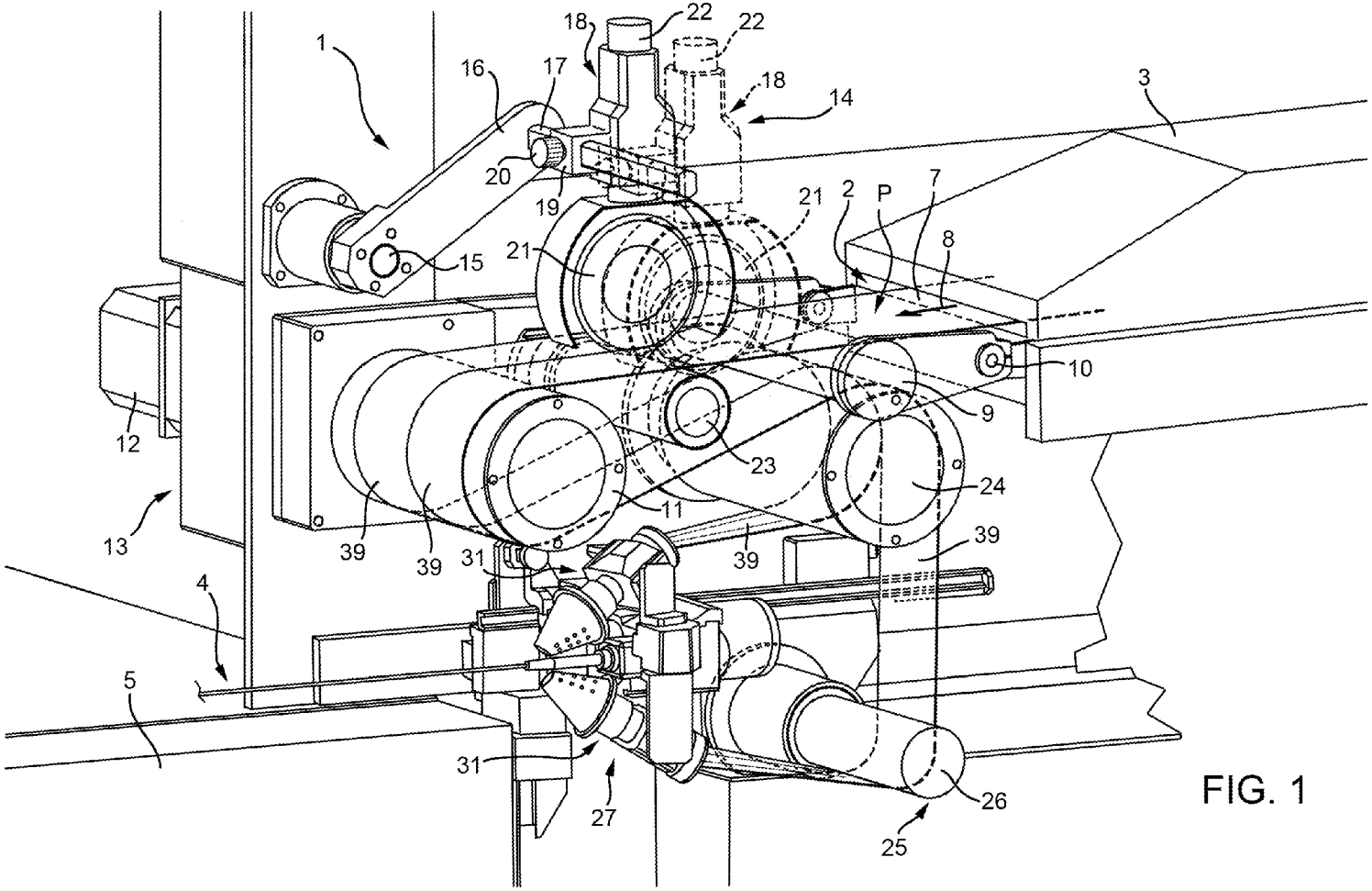
FIG. 1 shows a diagrammatic perspective view with parts removed for clarity of a preferred embodiment of the supply device of the present invention.
Figures 2, 3A, 3B, 3C:
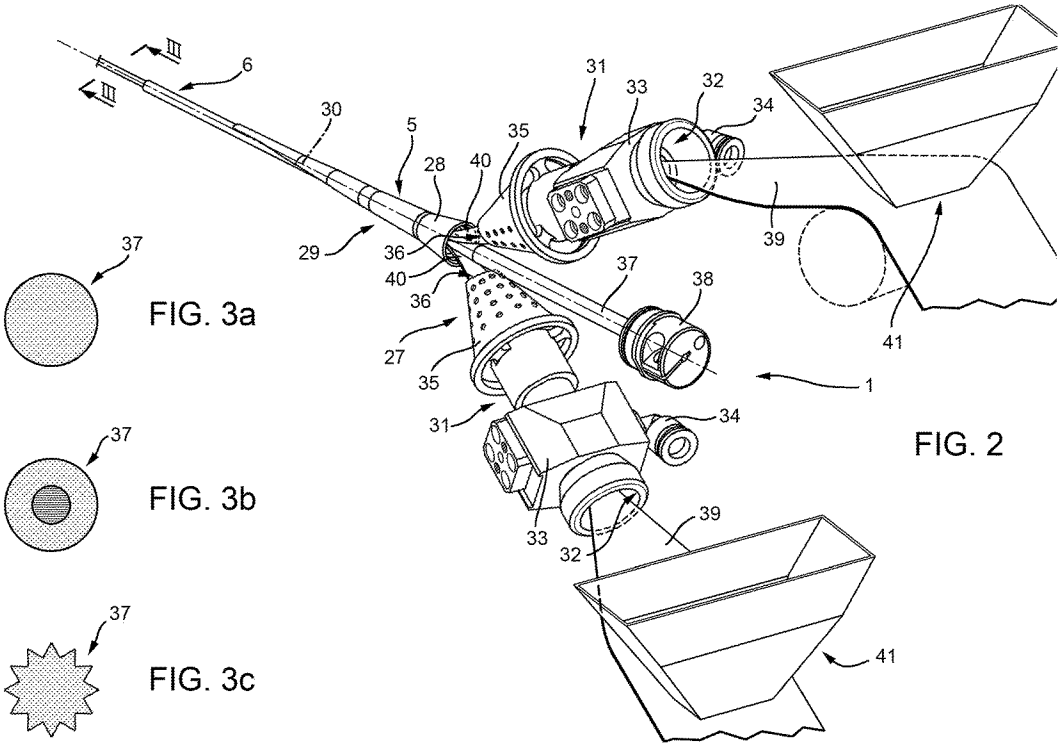
FIG. 2 shows a diagrammatic perspective, enlarged-scale view of a detail of FIG. 1.
FIGS. 3*a*, 3*b* and 3*c* show some alternative sections along line III-III of FIG. 2.

With reference to FIG. 1, reference numeral 1 denotes a supply device as a whole, interposed between an output mouthpiece 2 and an inlet unit 3 and an inlet station 4 of a continuous filter rod 6 forming machine 5 (FIG. 2).

The inlet unit 3 is of the known type and is adapted to unwind, from a bale (not shown) of compressed filter material, a continuous "tow" (not shown) consisting of a bundle of curled fibers of filter material; and to expand the tow (not shown) until it takes the shape of a flat band 7, which is fed to the supply device 1 through mouthpiece 2 and in an advancement direction 8.

The supply device 1 comprises an inlet roll 9, which is transversal to the advancement direction 8, is parallel to band 7 exiting from mouthpiece 2, and is mounted on the inlet unit 3 immediately downstream of mouthpiece 2 by the interposition of a movable fork 10 adapted to allow the adjustment of roll 9 with respect to mouthpiece 2.

The supply device 1 further comprises a deviating roll 11, which is motor-driven by a motor 12, is parallel to roll 9 and is supported in fixed position by a frame 13. Roll 11 is arranged downstream of roll 9 in the advancement direction 8 and with roll 9, it defines a plane P, along which band 7 is made to advance in use. Above plane P, the position of which is adjustable through roll 9, which serves as tensioning roll for band 7, the supply device 1 comprises a cutting unit 14 in turn comprising a motor-driven shaft 15 parallel to rolls 9 and 11 and mounted on frame 13 for oscillating about its axis, a lever 16 keyed on an end of shaft 15, and a guide 17 extending from the free end of lever 16 parallel to rolls 9 and 11 and directly arranged above plane P.

The cutting unit 14 further comprises at least one cutting head 18 mounted in adjustable position along guide 17 through the interposition of a slide 19 provided with a locking device 20 and comprising a cutting disc 21 actuated by a motor 22 and arranged in a plane perpendicular to plane P and parallel to the advancement direction 8.

In the embodiment example shown in FIGS. 1 and 2, guide 17 supports a single cutting head 18, which is movable with lever 16 between a raised rest position (not shown), in which the periphery of the respective cutting disc 21 is arranged above plane P, and a lowered cutting position, in which the respective cutting disc 21 extends through plane P.

According to some of the variants shown in the accompanying figures (for example in FIGS. 6 and 7), there are two cutting heads 18 (one of which, shown with a dashed line in FIG. 1, is omitted in the specific case of the embodiment of FIGS. 1 and 2); however, nothing prevents using more than two cutting heads 18 for particular applications, not shown.

In any case, each cutting disc 21, when in the cutting position, cooperates with a respective counter-cutting ring (not shown) idly carried by a counter-cutting roll 23 parallel to rolls 9 and 11 and arranged beneath plane P directly beneath guide 17.

Beneath plane P, the supply device 1 comprises a further return roll 24 parallel to rolls 9 and 11 and arranged beneath roll 9, and a final return unit 25 arranged beneath roll 24 and comprising at least one roll 26 parallel to roll 24. In particular, the number of rolls 26 provided in the return unit 25 is equal to the number of cutting heads 18 used. In particular, in the case of the embodiment of FIGS. 1 and 2, the return unit 25 comprises a single roll 26.

As better shown in FIG. 2, the supply device 1 finally comprises an output unit 27 arranged facing a funnel 28 defining the inlet of a forming beam 29, which extends along an axis 30 of the forming machine 5 and forms the inlet station 4 of the forming machine 5 itself.

As better shown in FIG. 2, the output unit 27 comprises known pneumatic devices 31 which are distributed about axis 30, converge towards each other and towards funnel 28 and are in a number equal to the number of cutting heads 18 increased by one. In particular, in the case of the embodiment of FIGS. 1 and 2, there are two pneumatic devices 31, they are arranged on opposing sides of axis 30 and each comprise a duct 32, which extends through an annular pneumatic distributor 33 forming the output end of a circuit 34 for supplying a compressed air flow, which enters duct 32 through a plurality of inclined holes (not shown).

Finally, each pneumatic device 31 comprises a funnel 35, which is connected to an output end of duct 32, is provided with lateral holes for venting the air fed into duct 32 from the supply circuit 34, and is provided with a top opening 36 facing the inlet of funnel 28.

As better shown in FIG. 2, the supply device 1 finally comprises a probe 37, which extends along axis 30, is inserted by part of its length into the forming beam 29 through the mouth of funnel 28 and comprises an initial stretch, which is arranged outside the forming beam 29 and between the pneumatic devices 31 and is coupled to the output of a motor 38, which is capable of imparting alternating movements to probe 37 itself, both oscillating about axis 30, and axial along axis 30 if the probe has a circular section (FIGS. 3*a* and 3*b*, which show respective cylindrical cores, a solid one and a tubular one), or only alternating axial movements if the section of probe 37 is not circular (FIG. 3*c*, which by way of example shows a probe 37 with star section).

In use, band 7, which in the advancement direction 8 protrudes from mouthpiece 2 of the inlet unit 3, rests on roll 9; then, it winds on roll 11 (in counter clockwise direction in FIG. 1) so as to define plane P; and is deviated by roll 11 towards roll 24, about which it winds in clockwise direction in FIG. 1.

During its advancement along plane P, band 7 is engaged by the cutting unit 14 which, in the case of the embodiment shown in FIGS. 1 and 2, comprises a single cutting disc 21, which has been lowered by actuating lever 16, to its cutting position for longitudinally cutting band 7 into two strips 39, which remain paired during their winding about rolls 11 and 24.

In general, the cutting head 18 is positioned and locked along guide 17 so as to obtain two strips 39 having substantially the same width; however, it should be noted that a different adjustment of the position of the cutting head 18 along guide 17 is always possible, and that the differences in the order of 20-30% in the width of the two strips 39 obtained do not affect the correct forming of filters 6 at all.

At the output of roll 24, the paths of the two strips 39 are separated from each other by the return unit 25; in particular, one of the strips 39 is directly fed to the inlet of duct 32 of the respective pneumatic device 31, while the other strip 39 winds about roll 36 before arriving at the inlet of duct 32 of the respective pneumatic duct 31. Each strip 39, crossing the respective pneumatic device 31, is impinged by a plurality of compressed air jets exiting from the pneumatic distributor 33, which advance strip 39 towards funnel 28 of the forming beam 29 and at the same time, they expand it so as to transform it into a substantially cylindrical cord 40.

The two cords 40 are fed into funnel 28 so as to arrange in symmetric positions with respect to probe 37, occupy all the space left free, into the forming beam 29, by probe 37, and produce a tubular filter 6 having a perfectly centered axial hole, the shape of whose section depends on the shape of the section of probe 37.

It is clear that in the case of the embodiment of FIGS. 1 and 2, which is directed to the forming of tubular filters 6, band 7 produced by the inlet unit 3 is impregnated, into the inlet unit 3 itself, with triacetin; and that the forming machine 5 is a machine for the production of filters without paper wrapping, into the forming beam 29 of which the two cords 40 are impinged with vapor jets adapted to almost instantly react triacetin and impart shape rigidity to the tubular filters 6 produced.

With regard to the description above, the following remarks are offered:

Being the two cords 40 produced starting from a same "tow", they have identical chemical-physical features and therefore, they do not generate any tension into the tubular filter 6 formed, with the consequence that the central hole of the tubular filter 6 remains perfectly centered irrespective of the fact that cords 40 and strips 39 generating them have different cross dimensions.

The lack of internal tensions allows tubular filters 6 to be obtained which remain perfectly rectilinear over time.

The use of a single "tow" for forming the whole peripheral axial portion of the filters makes the choice of the "tow" to be used similar to a standard choice and accordingly, allows the manufacturing costs to be greatly reduced.

Finally, by arranging a respective drugging station 41 on the path of each strip 39 upstream of the respective pneumatic device 31, as is shown in FIG. 2, it is possible to obtain cords 40 impregnated with different additives, the influences of which can be controlled, among the other things, by varying the widths of strips 39.

Figure 4:
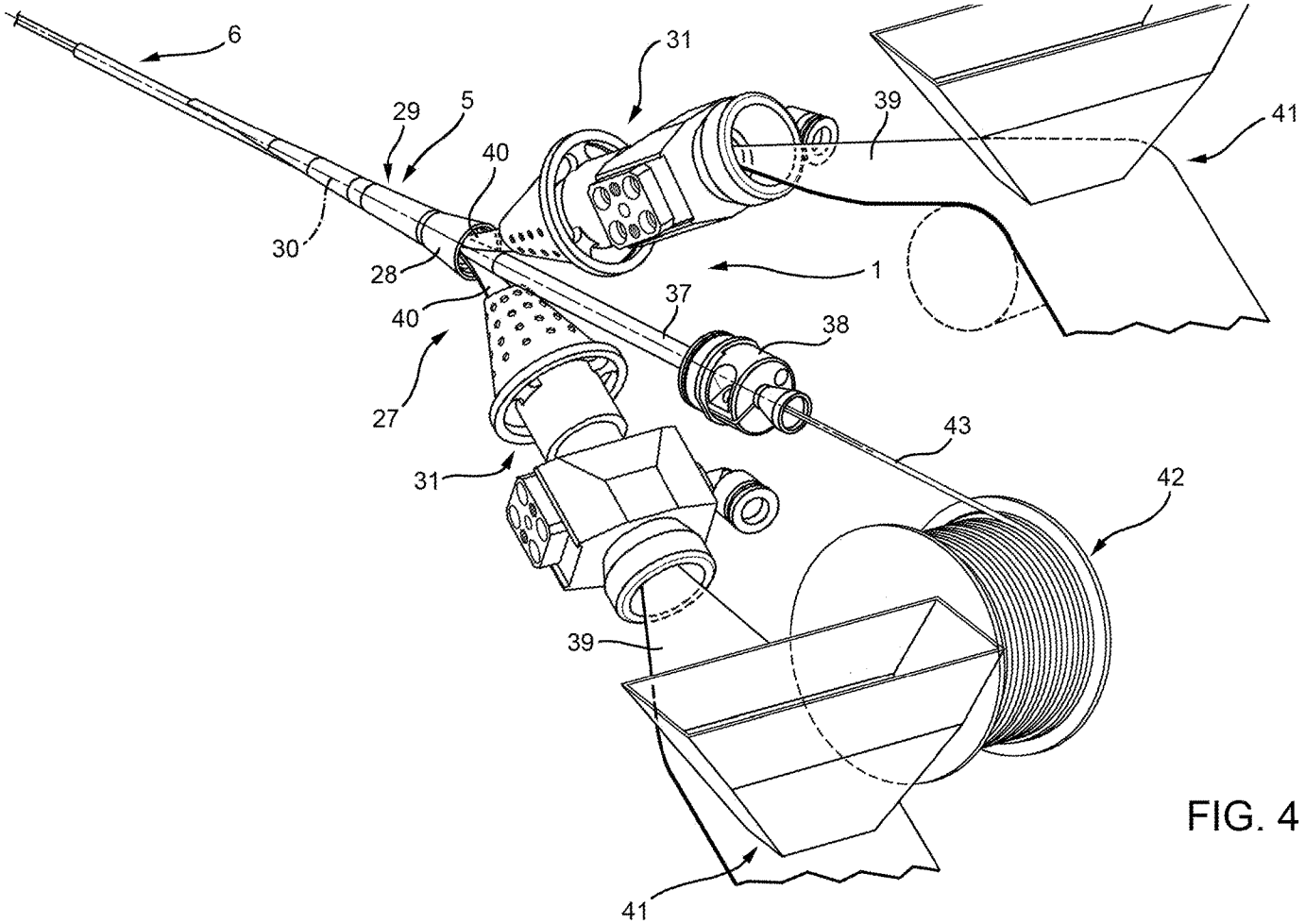
FIGS. 4 to 7 are similar to FIG. 2 and show respective variants of the detail of FIG. 2.

The supply device 1 shown in FIG. 4 differs from the supply device 1 of FIGS. 1 and 2 since probe 37 used is tubular (FIG. 3*b*) and is associated with a supply device 42 of a continuous wire 43, which is supplied through motor 38 and along probe 37 and released between cords 40 into the forming beam 29.

In this case, the forming machine 5 preferably is a traditional machine for the production of paper wrapped filters but nothing prevents using a machine for filters without paper wrapping.

In this case, moreover, using different additives for the two cords 40 and for wire 43 and moreover, optionally using strips 39 having different width, it is possible to not only control the pressure drop through the filter, but also to create a preferential passage path of the smoke through the filter.

Figure 5:
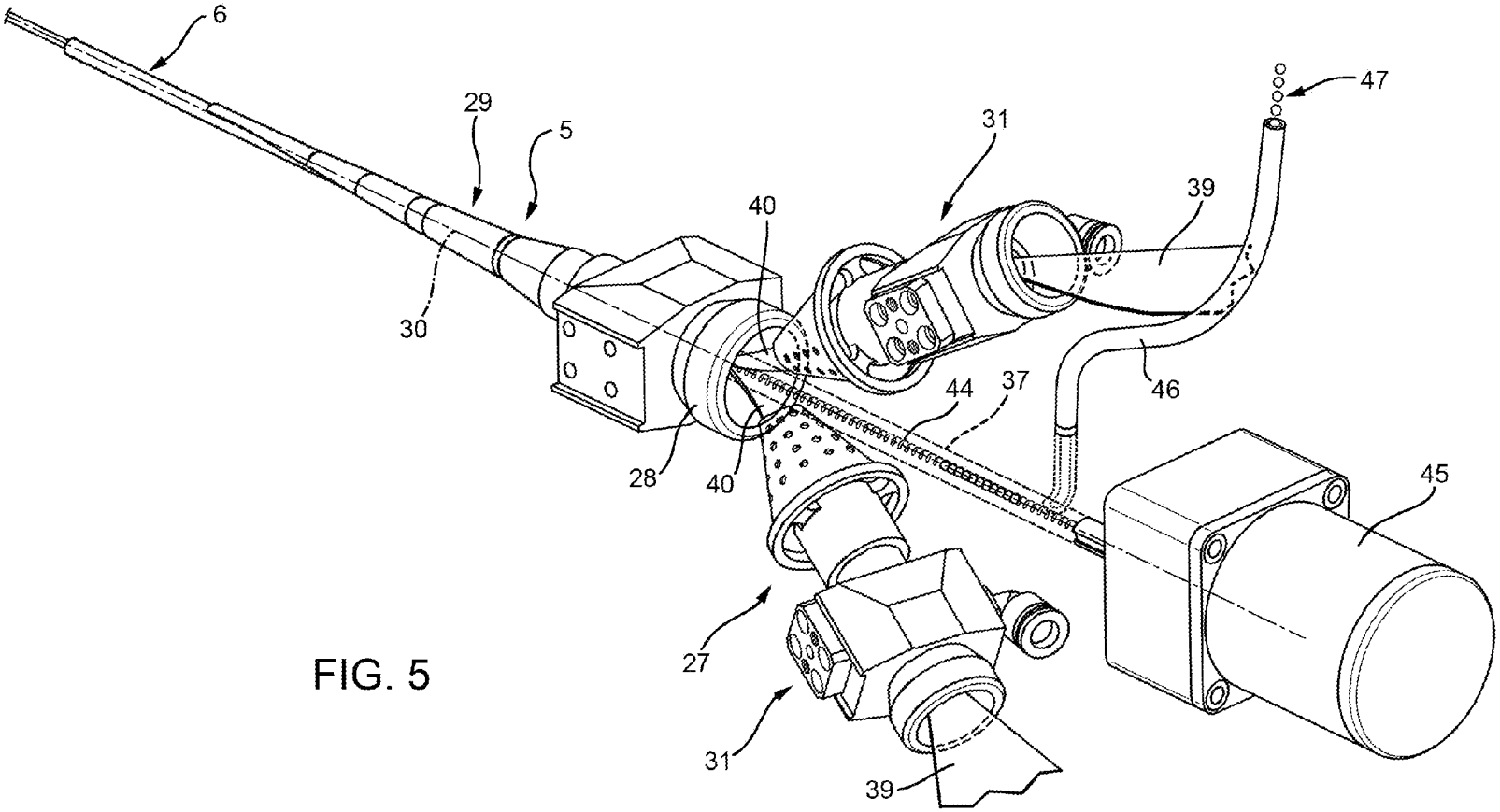

The supply device 1 shown in FIG. 5 differs from the supply device 1 of FIG. 4 only in that the tubular probe 37 used is fixed and is crossed by a screw 44, which is implemented by a spiral spring connected to the output of a motor 45. Probe 37 is provided with an inlet duct 46, which in the example shown is radially arranged and is adapted to feed a sequence of flavouring capsules 47 to screw 44, by dropping.

In this case, the forming machine 5 may be a traditional machine for the production of paper wrapped filters or a machine for filters without paper wrapping.

The embodiment shown in FIG. 5 highlights the fact that, if the supply device 1 is used in association with a forming machine 5 for filters without paper wrapping and a tubular probe 37, it is possible to supply, into the perfectly centered duct that is formed into the substantially rigid tubular filter rod that leaves the terminal end of probe 37, any particulate material, which into the continuous tubular rod will form a core, the density of which will be according to the dimensions of the particles of the particulate material and to their relative speed with respect to the continuous tubular rod.

In other words, using the supply device 1 in association with a forming machine 5 for filters without paper wrapping and a tubular probe 37, it is possible to implement a continuous filter rod without wrapping provided with a perfectly centered axial core of a particulate material, for example activated carbon, the permeability of which to the smoke drawn may be changed as desired by varying the dimensions of the granules and their relative supply speed.

Figure 6:
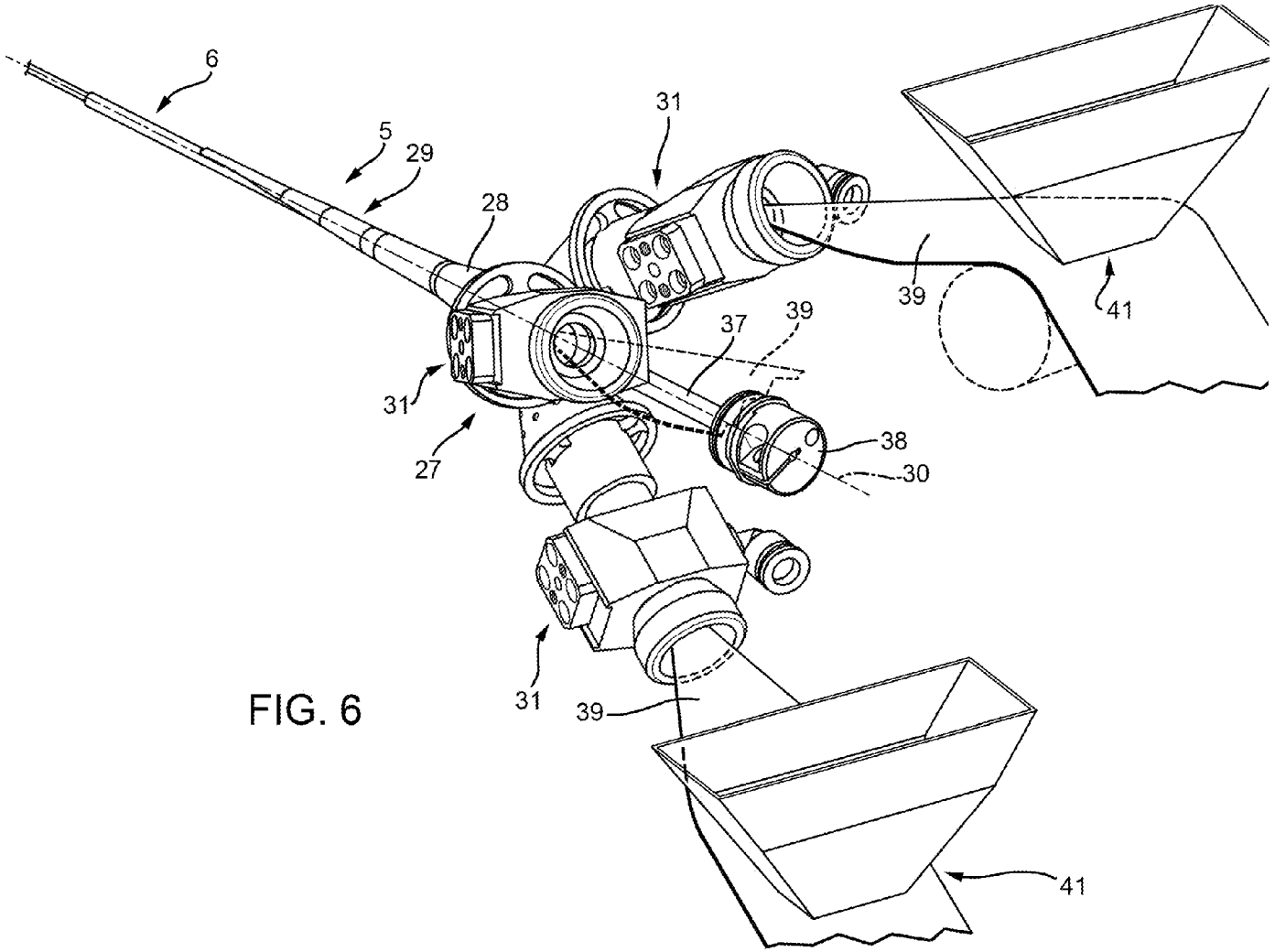

The supply device 1 shown in FIG. 6 is similar to that of FIG. 1, but uses a cutting unit 14 (not shown) provided with two cutting heads 18 and with a return unit 25 (not shown) provided with two rolls 26 for obtaining three strips 39, each one of which is supplied to a respective pneumatic device 31. In the supply device 1 of FIG. 6, the three pneumatic devices 31 are evenly distributed about axis 30 and the central probe 37 for forming a continuous rod of tubular filter (not shown), the peripheral portion of which is divided into three sectors, which may be differently drugged.

In the embodiment shown in FIG. 6, the forming machine used of course is a machine for the production of filters without paper wrapping.

Figure 7:
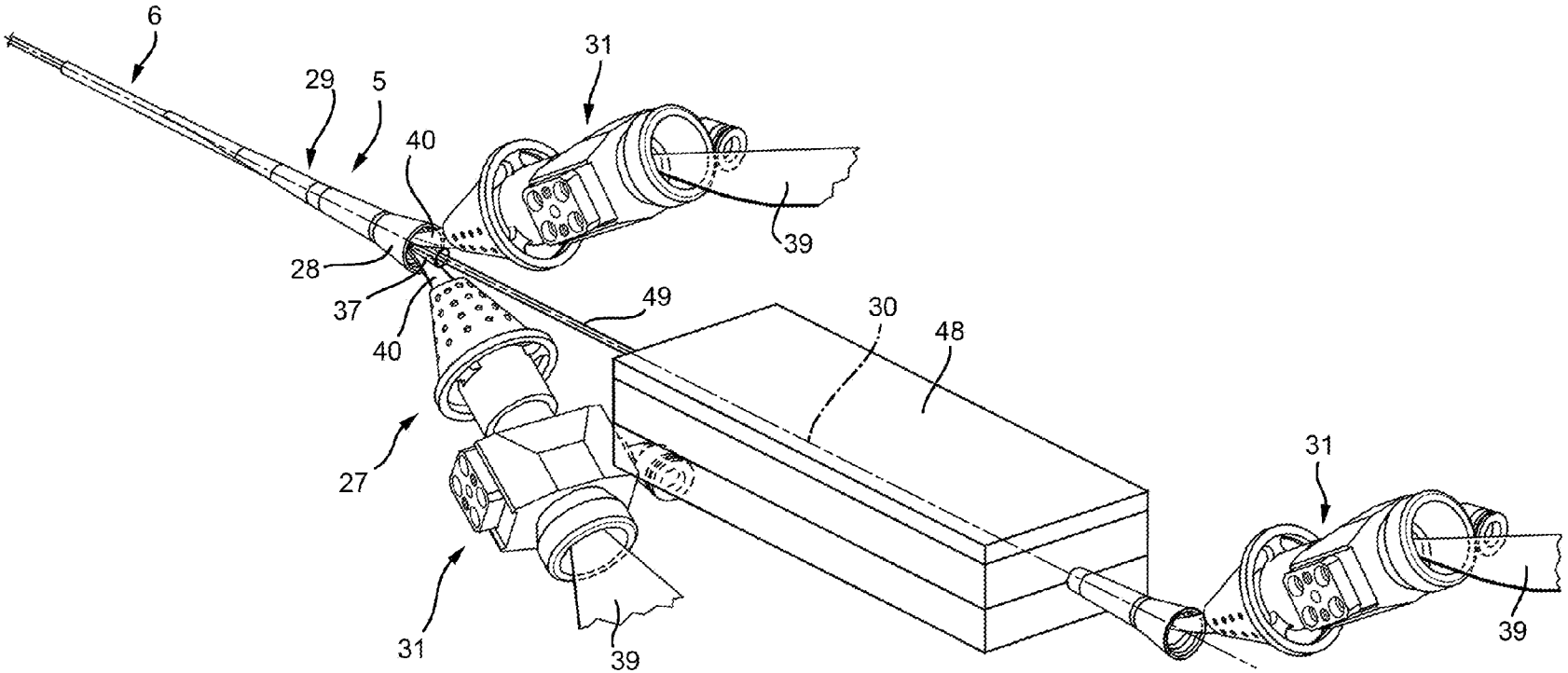

Similar to the embodiment of FIG. 6, also the supply device 1 of FIG. 7 uses a cutting unit 14 (not shown) provided with two cutting heads 18 and with a return unit 25 (not shown) provided with two rolls 26 for obtaining three strips 39, each one of which is supplied to a respective pneumatic device 31.

Differently from the embodiment of FIG. 6, in the supply device 1 of FIG. 7, two of the pneumatic devices 31 are arranged like the two pneumatic devices 31 of FIG. 2 and supply their cords 40 about a tubular probe 37 and into the forming beam 29 of a forming machine of filters with or without paper wrapping, while the third pneumatic device 31 is arranged upstream of the other two and supplies its cord 40 along axis 30 and to the inlet of a forming beam 48 for filters without paper wrapping arranged in series to the forming beam 29 along axis 30 and capable of forming a rigid continuous rod 49, which is supplied to the forming beam 29 through probe 37 for forming rods 6 having an annular outer axial portion surrounding a rigid inner core.

Finally, according to a variant not shown, the cutting disc 21 or the cutting discs 21, if two or more cutting heads 18 are provided, may be replaced with any other cutting device suitable for the purpose, for example a compressed air blade.

The invention claimed is:

1. A method for supplying filter material to a filter rod forming machine, each filter rod comprising a peripheral axial portion and a central axial portion, the filter rod forming machine having an inlet having an axis, and the method comprising the steps of:

providing an inlet unit having an output mouthpiece, the inlet unit being designed to work a single "tow" so as to transform the single "tow" into a flat band, and to feed the flat band to the output mouthpiece, and supplying the flat band to said inlet;

longitudinally cutting the flat band in at least two strips at a position between the output mouthpiece and said inlet;

transforming the at least two strips into at least two cords;

providing a probe coaxial to said axis through said inlet to define said central axial portion;

feeding the at least two cords transformed from the at least two strips to said inlet at positions evenly distributed about the axial probe to form said peripheral axial portion.

2. The method claimed in claim 1, wherein the at least two strips have equal widths.

3. The method claimed in claim 1, wherein the at least two strips have different widths.

4. The method claimed in claim 1, wherein the probe is a full mandrel of any cross-section, said central axial portion being an axial duct.

5. The method claimed in claim 1, wherein the probe is a tubular probe, the method further comprising supplying, to the filter rod forming machine and through the tubular probe, a forming material for the central axial portion.

6. The method claimed in claim 5, wherein said filter material is in the form of a continuous thread.

7. The method claimed in claim 5, wherein said filter material is a particulate material.

8. The method claimed in claim 7, wherein said particulate material comprises capsules or granules.

9. The method claimed in claim 1, wherein the at least two strips consist of three strips.

10. The method claimed in claim 5, further comprising:

the transforming of the at least two strips into the at least two cords comprising transforming the at least two strips to form a first, a second and a third cord;

feeding the first and second cord to said inlet in positions evenly distributed about the tubular probe;

stiffening the third cord; and feeding the third cord to said inlet through the tubular probe.

11. The method claimed in claim 1, and further comprising drugging at least one strip of the at least two strips with a respective additive.

12. A device for supplying filter material to a filter rod forming machine, each filter rod comprising a peripheral axial portion and a central axial portion; the filter rod forming machine having an axis and an inlet coaxial to the axis; the device being designed to be interposed between the machine and an inlet unit having an output mouthpiece and designed to work a single "tow" so as to transform the single tow into a flat band and feed the flat band to the output mouthpiece; and the device comprising:

a probe designed to be mounted through said inlet coaxially to said axis;

cutting means for cutting the flat band into at least two strips;

pneumatic advancement means for transforming the at least two strips into at least two cords and for supplying the at least two cords to said inlet at positions distributed about the probe; and guide means for feeding each strip to the pneumatic advancement means along a respective path.

13. The device claimed in claim 12, wherein the cutting means are adjustable for cutting the flat band into flat strips of equal width.

14. The device claimed in claim 12, wherein the cutting means are adjustable for cutting the flat band into strips of different widths.

15. The device claimed in claim 12, wherein the probe is a full mandrel of any cross section.

16. The device claimed in claim 12, wherein the probe is a tubular probe.

17. The device claimed in claim 16, further comprising supply means for feeding a continuous wire through said tubular probe.

18. The device claimed in claim 16, further comprising supply means for a particulate material through said tubular probe.

19. The device claimed in claim 18, wherein said particulate material comprises capsules or granules.

20. The device claimed in claim 12, wherein the cutting means are designed so as to cut the flat band into three said strips.

21. The device claimed in claim 16, further comprising stiffening means disposed on said path downstream from the pneumatic advancement means to feed a cord of the at least two cords to the machine through the tubular probe.

22. The device claimed in claim 12, further comprising drugging means arranged on said path to drug each strip with a respective additive.

23. A system comprising a filter rod forming machine, each filter rod comprising a peripheral axial portion and a central axial portion; the filter rod forming machine having an axis and an inlet coaxial to the axis; an inlet unit having an output mouthpiece and designed to work a single "tow" so as to transform the single tow into a flat band and feed the flat band to the output mouthpiece; and a supply device interposed between the machine and the inlet unit; the supply device being a device according to claim 12.

24. The system claimed in claim 23, wherein the filter rod forming machine is a machine for a production of paper wrapped filters.

25. The system claimed in claim 23, wherein the machine is a machine for a production of filters without paper wrapping.

* * * * *